United States Patent [19]

James

[11] Patent Number: 4,712,257

[45] Date of Patent: Dec. 15, 1987

[54] INVALID HOISTS

[75] Inventor: David R. James, Tirley, England

[73] Assignee: Impro Limited, Gloucestershire, England

[21] Appl. No.: 934,786

[22] Filed: Nov. 25, 1986

[30] Foreign Application Priority Data

Dec. 21, 1985 [GB] United Kingdom ..... 8531561
Aug. 15, 1986 [GB] United Kingdom ..... 8619894

[51] Int. Cl.[4] ..... A61G 7/10

[52] U.S. Cl. ..... 5/83; 5/86; 5/89

[58] Field of Search ..... 5/81 R, 83, 86, 87, 5/89; 294/140

[56] References Cited

U.S. PATENT DOCUMENTS

Re.28,620 11/1975 Jordan et al. ..... 5/86
977,243 11/1910 White ..... 5/89
3,137,011 6/1964 Fischer ..... 5/86
3,234,568 2/1966 Fischer ..... 5/89
3,608,104 9/1971 VanGerven ..... 5/83
4,409,696 10/1983 Bakker ..... 5/89

FOREIGN PATENT DOCUMENTS 1094405 12/1967 United Kingdom ..... 5/81 R

*Primary Examiner*—Alexander Grosz
*Assistant Examiner*—Michael F. Trettel
*Attorney, Agent, or Firm*—Collard, Roe & Galgano

[57] ABSTRACT

An invalid hoist has a lifting arm, a sling hanger support mounted to turn about a rigid vertical bearing axis at the outer end of the arm and a sling hanger which is a unitary construction pivotable about a horizontal axis relative to the sling hanger support. The sling hanger presents spaced sling attachment points on both sides of the horizontal axis for connection of one pair of sling attachments to one side of the horizontal axis and for connection of a second pair of sling attachments to the opposite side of the horizontal axis. Thus the disposition of a sling-suspended invalid can be changed, while suspended on the hoist, by pivotal movement of the sling hanger about the horizontal axis.

14 Claims, 5 Drawing Figures

INVALID HOISTS

BACKGROUND OF THE INVENTION

1. Field of the Invention

The invention relates to invalid hoists for use with lifting slings in which invalids are suspended during lifting. It is particularly concerned with such a hoist which embodies a sling hanger presenting spaced sling attachment points and mounted at the outer end of a lifting arm of the hoist so as to pivot about a rigid vertical bearing axis.

The term "rigid" as used herein with reference to said vertical bearing has the special meaning that the bearing axis remains substantially vertical throughout the range of lifting movement of the arm. The rigid vertical bearing prevents the free pendulum-like swinging movement of a suspended invalid which is a marked disadvantage of a hoist having a freely suspended sling hanger without such a bearing. Thus the rigid vertical bearing provides a considerable advantage during transport of a suspended invalid with a mobile hoist as it prevents possible injury and provides a psychologically important feeling of security.

2. Description of the Prior Art

Prior hoists employing such a bearing have the disadvantage that the sling hanger adopts a fixed disposition relative to the bearing axis which limits its range of application so far as different lifting procedures are concerned. This disadvantage does not arise with a simple hanger which presents only two spaced suspension points but it is immediately apparent with a more complex hanger arrangement presenting more than two suspension points, for example two spaced pairs of suspension points to which separate back and seat/leg slings, or an equivalent one-piece sling, can be attached. In this case the arrangement is not readily adaptable for the support of an invalid in alternative dispositions.

SUMMARY OF THE INVENTION

The object of the invention is to provide a hoist which maintains the advantages of prior rigid vertical bearing arrangements whilst overcoming the foregoing disadvantage thereof.

According to the invention an invalid hoist has a lifting arm, a sling hanger support mounted to turn about a rigid vertical bearing axis at the outer end of the arm, and a sling hanger which is a unitary construction pivotable about a horizontal axis relative to the sling hanger support and which presents spaced sling attachment points on both sides of said horizontal axis, for connection of one pair of sling attachments to one side of the horizontal axis and for connection of a second pair of sling attachments to the opposite side of the horizontal axis.

Preferably four sling attachment points are provided arranged to present a first pair of spaced sling attachment points disposed to one side of said horizontal axis and a second pair of spaced sling attachment points disposed to the opposite side of said horizontal axis. In this case both pairs of attachment points may be comparatively widely spaced for the connection of separate back and seat/leg slings, or an equivalent one-piece sling. However, in a preferred embodiment one pair of attachment points is comparatively widely spaced for connection of shoulder region attachments of a one-piece sling whereas the other pair are relatively closely spaced. Such a hanger arrangement can be used with a one-piece sling which comprises a main portion to support the body of the invalid and lower end dependent leg support portions which in use respectively extend beneath and upwardly between the thighs of the invalid with the ends of the leg support portions connected to the closely spaced pair of attachment points.

Means are preferably provided for locating the hanger in selected different angular positions about said horizontal axis. Such means may allow the hanger to be infinitely adjustable in position throughout an operative range of angular movement and to this end may operate to provide frictional restraint to movement of the hanger about the horizontal axis.

Due to the ability to use the hoist with the hanger in alternative angular dispositions the invention provides the advantage that the disposition of the suspended invalid can be changed without adjustment of the sling or slings in use, or the attachment thereof to the hanger. For example, the invalid can be lifted off a bed with the hanger in one angular disposition, the hanger then being moved about the horizontal axis to an alternative angular disposition which positions the invalid in a more or less seated position for transfer to an invalid chair or toilet.

Elevating means of the hoist may be operative to raise and lower the lifting arm with a solely translatory movement, but in a preferred construction the arm is of parallelogram form and pivotally mounted on an upstanding column or support structure of the hoist.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be made as desired by those skilled in the art without departing from the present invention and the purview of the appended claims.

DESCRIPTION OF THE PREFERRED EMBODIMENTS

Figure 1:
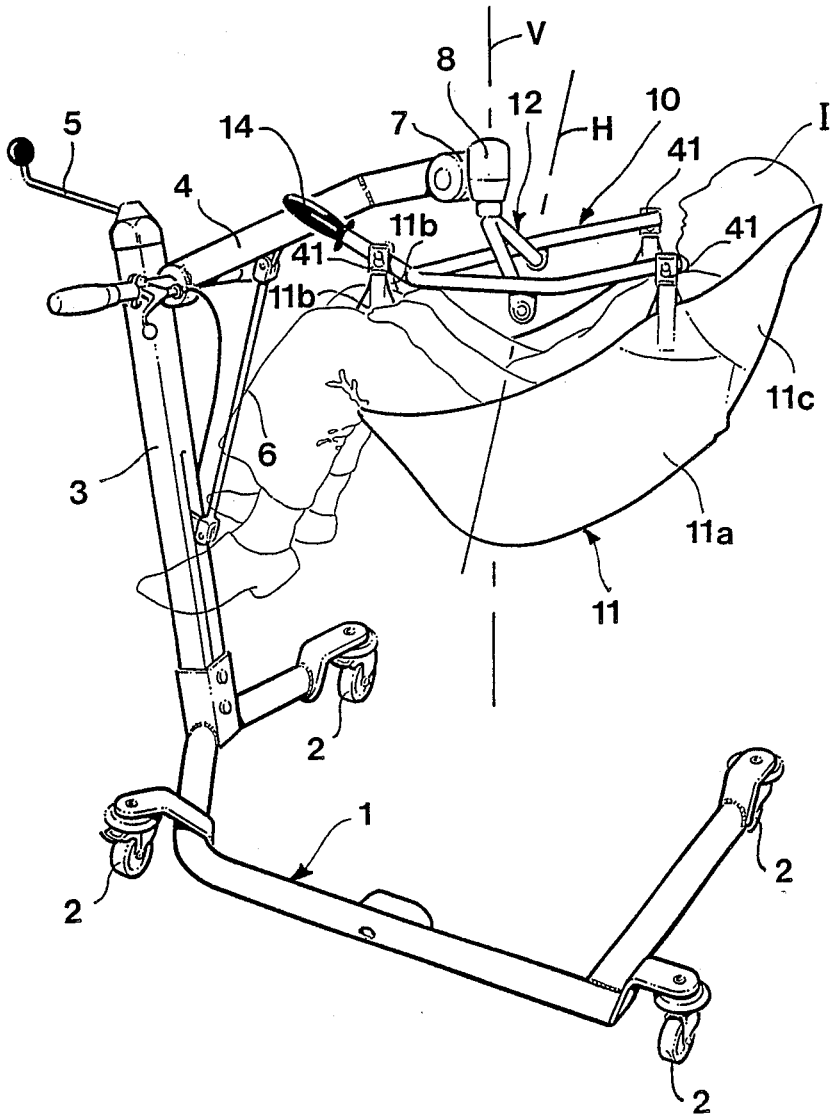
FIG. 1 is a diagrammatic perspective view of a hoist embodying a sling hanger representing a preferred embodiment of the invention.

The hoist illustrated comprises a mobile chassis 1 which incorporates castors 2 and supports at the rear an upstanding column 3. The column 3 in turn supports a lifting arm 4 which is raised and lowered by means of a screw-and-nut elevating mechanism housed within the column 3 and operated by a top winding handle 5. The nut of the elevating mechanism is connected to the arm 4 through a pivotal support strut 6. The arm 4 is of parallelogram type comprising parallel links, one shrouded within the other, pivotally mounted on the column 3. As a result an end portion 7 of the arm 4 remains horizontal at all times as the arm 4 is raised and lowered by the elevating mechanism under the control of the handle 5. A hanger support bearing 8 at the end of the arm portion 7 defines a rigid vertical bearing axis V, that is to say an axis which remains vertical as the arm 4 pivots throughout its range of lifting movement.

FIG. 1 illustrates a sling hanger 10 with an attached one-piece sling 11 in which an invalid I is suspended. The hanger 10 is of unitary tubular metal construction and is pivotally supported, from the arm 4, by a sling hanger support 12 so that it is pivotable about a horizontal axis H relative to the sling hanger support 12. The hanger support 12 is mounted in the vertical bearing 8 so that the sling hanger 10 is mounted to turn about the rigid vertical axis V with the hanger support 12, whilst being separately pivotable about the horizontal axis H. As can be seen from the drawings the hanger 10 is underslung with respect to the vertical bearing 8.

The hanger 10 comprises a central member 13 which at its outer end is provided with a moulded handgrip 14 so that it can comfortably be gripped by an operator and used as a lever to change the angular disposition of the hanger 10 about the horizontal axis H whilst the invalid I is suspended. The remainder of the hanger 10 is of generally V-shaped form welded to the inner end of the member 13. It comprises side limbs 15 and 16 which consist of mutually divergent inner portions 15*a* and 16*a* and straight generally parallel outer end portions 15*b* and 16*b*. The sling hanger support 12 is of bifurcated form with mutually divergent limbs 17 and 18 which connect with the limbs 15 and 16 of the hanger 10 through pivot bearings 19 and 20, respectively.

Figure 2:
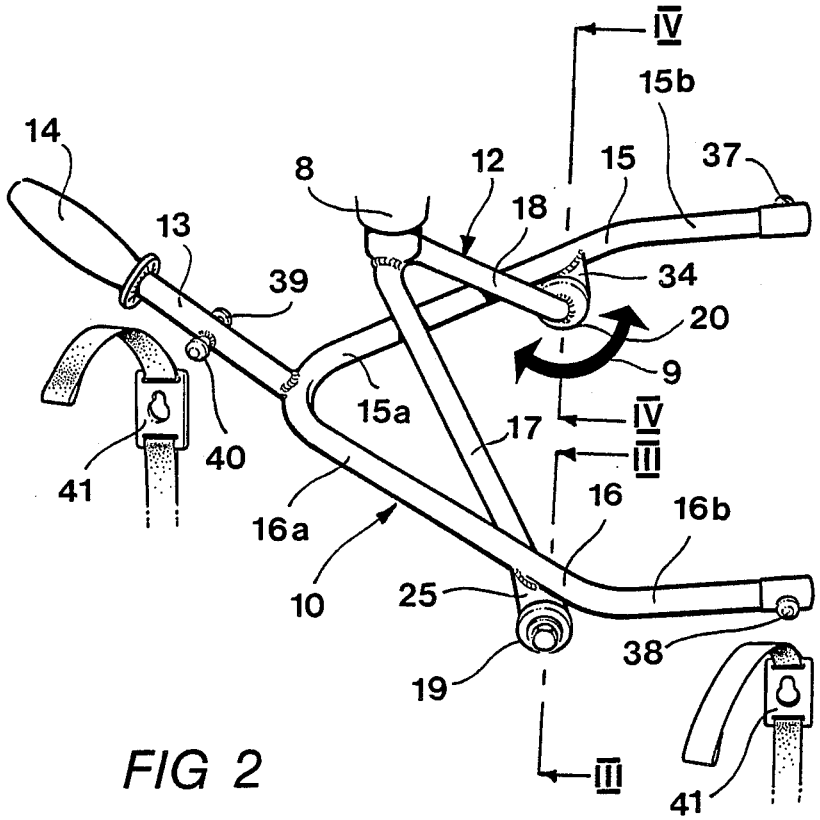
FIG. 2 is a similar view of the preferred sling hanger to a larger scale.
Figure 3:
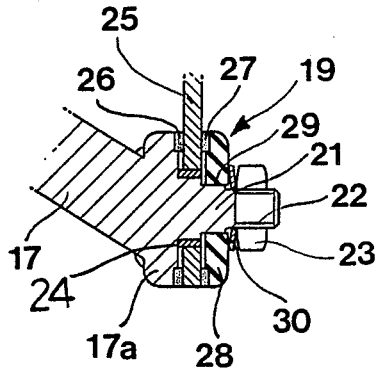
FIGS. 3 and 4 are respectively detail sectional views on the line III—III and IV—IV in FIG. 2.
Figure 4:
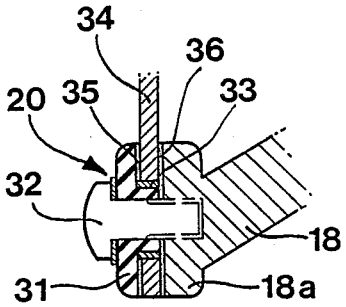

FIG. 3 illustrates the construction of the pivot bearing 19. The limb 17 terminates in a circular boss 17*a* and a horizontal stepped stub 21 which at its smallest outer end diameter is screw threaded at 22 to receive a self-locking nut 23. At its largest inner end diameter the stub 21 supports a bearing sleeve 24 on which a web 25 welded to the hanger limb 16 can pivot. The web 25 is clamped between two annular friction discs 26 and 27 by a clamp disc 28 mounted on a square-section intermediate portion 29 of the stub 21. The friction discs 26 and 27 apply frictional restraint to the hanger 10 and thus serve as means for locating the hanger in any adjusted angular disposition about the horizontal axis H throughout the range of movement indicated by the arrow 9 in FIG. 2. The frictional clamping force is applied to the disc 28 by the nut 23 through a Belville washer 30 so that a degree of frictional restraint is preset whilst being readily adjustable.

The pivot bearing 20 does not apply frictional restraint to the hanger 10. A stepped disc 31 secured to a circular boss 18*a* at the end of the limb 18 by a bolt 32 supports a bearing sleeve 33 on which a web 34 connected to the hanger limb 15 is freely rotatable. A thrust bearing ring 35 is disposed between the disc 31 and the web 34, and a thrust bearing ring 36 is disposed between the other side of the web 34 and the boss 18*a*.

At their outer ends the limbs 15 and 16 of the hanger 10 present comparatively widely spaced sling attachment points in the form of outwardly facing headed studs 37 and 38. The hanger 10 presents a second pair of relatively closely spaced sling attachment points disposed on the opposite side of the horizontal axis H and again in the form of outwardly facing headed studs 39 and 40. The studs 39 and 40 are fixed on opposite sides of the central member 13. The studs 37,38,39 and 40 are designed for connection to the hanger 10 of sling attachments in the form of keyhole plates such as 41 illustrated in FIGS. 1 and 2. The hanger arrangement illustrated in these two figures, that is with one pair of comparatively widely spaced sling attachment points (studs 37 and 38) and a second pair of relatively closely spaced sling attachment points (studs 39 and 40) is designed for use with a one-piece sling of the general form illustrated in FIG. 1. Such a sling 11 comprises a main portion 11*a* which supports the body of the invalid I and at the shoulder region connects to the studs 37,38 and dependent leg support portions 11*b* which extend beneath and upwardly between the thighs of the invalid I and the ends of which are attached to the closely spaced pair of studs 39,40.

Figure 5:
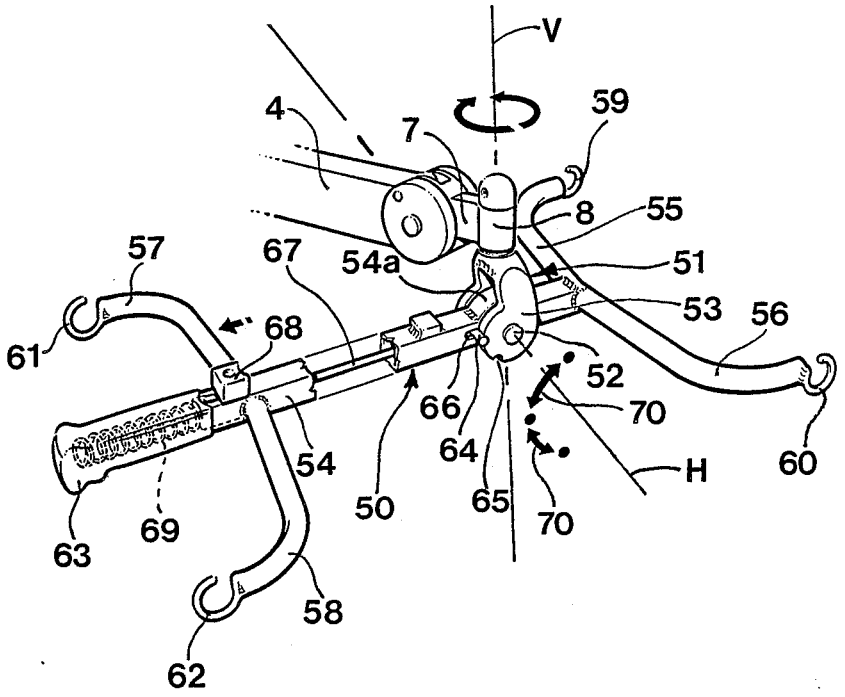
FIG. 5 is a perspective view of a modified sling hanger construction.

The modified hanger arrangement illustrated in FIG. 5 similarly comprises a unitary hanger 50 which is pivotable about a horizontal axis H relative to a sling hanger support 51 mounted in the rigid vertical bearing 8 of the hoist. The hanger support 51 in this case is in the form of a connecting yoke which supports the hanger 50 on a pivot pin 52 extending between and through the two vertical limbs 53 of the yoke 51. The pin 52 thus defines the horizontal pivot axis H and in this construction the mutually perpendicular bearing axes V and H intersect one another on a central longitudinal axis of the sling hanger 50, which is again underslung with respect to the vertical bearing 8.

A main central member 54 of the hanger 50 is of square-section metal tubing and has an enlarged intermediate bearing portion 54*a* through which the pivot pin 52 passes. Two pairs of arms 55,56 and 57,58 project laterally from the central member 54. The arms 55,56 are disposed closer to the pivot axis H than are the arms 57,58 and they are provided by a single tubular member welded to one end of the central member 54. The other arms 57,58 are separate tubular members respectively welded to opposite sides of the central member 54.

All the arms 55,56,57,58 are of similar shape and are curved away from the axis H, and they respectively terminate in sling attachment hooks 59,60,61 and 62. Separate back and seat/leg support slings can respectively be attached to the two spaced pairs of hooks 59,60 and 61,62, or an equivalent one-piece sling can be attached to all four hooks. Such slings are not shown and may be of well known conventional form. The central member 54 is extended at the end remote from the arms 55,56 where it is provided with a moulded handgrip 63 for the same purpose as the handgrip 14 previously referred to.

The hanger 50 can be selectively located in alternative angular dispositions, throughout the range of movement as indicated by the arrows 70, by manually-operable spring-loaded catch means. Such means comprise a catch member 64 which projects at each side of the central member 54 and is operatively engageable with detent notches such as 65 formed in the yoke limbs 53. The catch member 64 is slidably guided in guide slots 66 in the central member 54 and is attached to one end of an operating rod 67 which is connected to a release member 68 mounted for finger operation at the top of the member 54. A spring 69 urges the rod 67 in the catch-engaging direction.

In each case the pair of attachment points 37,38 or 59,60 which support the sling or slings used at the upper or "head" end of the suspended invalid and the other pair of attachment points 39,40 or 61,62 are so disposed relative to the horizontal axis H that a substantially dynamically balanced condition is produced. The sling arrangement is desirably such that the axis H is in proximity to the centre of gravity of the invalid but somewhat above it to provide a stable suspended condition.

Thus it is comparatively easy to change the invalid's attitude by pivotal movement of the hanger 10 or 50 about the axis H, and with the arrangement of FIGS. 1 to 4 the degree of frictional restraint required to retain the hanger 10 in the adjusted disposition need only be such that a small force applied to the handgrip 14 will effect adjustment. Experiment has shown that with a one-piece sling as illustrated in FIG. 1 a range of four sizes of slings will accommodate the full range of invalid weight up to 25 stone (159 Kgm) with the invalid suitably positioned relative to the horizontal axis H.

As compared with prior sling hangers which have attachment points disposed generally in line laterally of the vertical bearing axis V the positioning of the sling attachment points with a hanger in accordance with the invention has the effect of extending the useful lifting range of the hoist. For example, with the hoist arm at its fully lowered position the hanger can be tipped forwardly about the axis H to pick up a supine invalid from the floor, the hanger being pivoted after attachment of the sling to bring the invalid to a generally sitting position. Thus pivotal movement of the hanger in effect provides an initial lift to the sitting position.

The sling 11 shown by way of example in FIG. 1 has an integral head support section 11*c*. When either of the illustrated hangers is to be used with a conventional one-piece sling which does not provide support above the shoulders of an invalid or with separate back and seat/leg slings a detachable head support (not shown) may be provided. This may be detachable and in use rigidly attached to the side limbs 15 and 16 or side arms 55 and 56. A head support is particularly useful when a hoist is used with an invalid whose head would otherwise flop about unless supported by an attendant who is thus freed for other duties.

I claim:

1. An invalid hoist comprising a lifting arm, a sling hanger support mounted at the outer end of said arm so as to turn about a rigid vertical bearing axis, a sling hanger which is a unitary construction supported by said sling hanger support so as to be pivotable about a horizontal axis relative to the sling hanger support, said sling hanger presenting spaced sling attachment points on both sides of said horizontal axis for connection of one pair of sling attachments to one side of the horizontal axis and for connection of a second pair of sling attachments to the opposite side of the horizontal axis, and means for locating said sling hanger in angular position about said horizontal axis and which allow the latter to be infinitely adjustable in position throughout an operative range of pivotal movement about said horizontal axis.

2. An invalid hoist according to claim 1, wherein four of said sling attachment points are provided and arranged to present a first pair of spaced sling attachment points disposed to said one side of said horizontal axis and a second pair of sling attachments points disposed to said opposite side of said horizontal axis.

3. An invalid hoist according to claim 2, wherein both said pairs of attachment points are comparatively widely spaced and adapted for connection of separate back and seat/leg slings or an equivalent one-piece sling.

4. An invalid hoist according to claim 2, wherein the attachment points of one of said pairs thereof are comparatively widely spaced for connection of shoulder region attachments of a one-piece sling having lower end leg dependent support portions which in use respectively extend beneath and upwardly between the thighs of the invalid, and the attachment points of said other pair thereof are relatively closely spaced for connection of the leg support portions of the sling.

5. An invalid hoist according to claim 1, wherein said means for locating the hanger provide frictional restraint to movement of the hanger about said horizontal axis.

6. An invalid hoist according to claim 5, wherein the frictional restraint provided by said means for locating the hanger is adjustably preset.

7. An invalid hoist according to claim 1, further comprising a vertical bearing which provides said rigid vertical axis, said horizontal pivot axis being disposed below said vertical bearing so that the hanger is underslung with respect to the vertical bearing.

8. An invalid hoist according to claim 1, wherein said lifting arm is of parallelogram form and pivotally mounted on an upstanding column of the hoist.

9. An invalid hoist according to claim 1, wherein said hanger construction also comprises two opposite side arms which project from said central member at an intermediate length position thereof, another pair of said spaced sling attachment points respectively being presented at outer ends of said side arms.

10. An invalid hoist according to claim 1, wherein said attachment points of the sling hanger are provided by headed studs engageable by said sling attachments in the form of keyhole plates.

11. An invalid hoist comprising a lifting arm, a sling hanger support mounted at the outer end of said arm so as to turn about a rigid vertical bearing axis, a sling hanger which is a unitary construction supported by said sling hanger support so as to be pivotable about a horizontal axis relative to the sling hanger support, said sling hanger presenting spaced sling attachment points on both sides of said horizontal axis for connection of one pair of sling attachments to one side of the horizontal axis and for connection of a second pair of sling attachments to the opposite side of the horizontal axis, and catch means for locating said sling hanger in angular position about said horizontal axis comprising a spring-loaded catch which selectively locates and retains the sling hanger in two or more alternative angular positions about said horizontal axis.

12. An invalid hoist comprising a lifting arm, a sling hanger support mounted at the outer end of said arm so as to turn about a rigid vertical bearing axis, a sling hanger which is a unitary construction supported by said sling hanger support so as to be pivotable about a horizontal axis relative to the sling hanger support, said sling hanger presenting spaced sling attachment points on both sides of said horizontal axis for connection of one pair of sling attachments to one side of the horizontal axis and for connection of a second pair of sling attachments to the opposite side of the horizontal axis, and siad sling hanger comprising a central member which extends at one end of the sling hanger as a handgrip adapted to be grasped by an attendant whereby said central member can be used as a lever to pivot the sling hanger about said horizontal axis.

13. An invalid hoist according to claim 12, wherein said hanger construction further comprises two arms projection transversely of said central member at the end thereof remote from said handgrip, one pair of said spaced sling attachment points respectively being presented at outer ends of said two arms.

14. An invalid hoist according to claim 13, wherein another pair of said attachment points are provided on opposite sides of said central member itself.

* * * * *